United States Patent [19]

Kramer

[11] Patent Number: 4,736,529

[45] Date of Patent: Apr. 12, 1988

[54] DEVICE FOR THE UNIFORM APPLICATION OF GAS ON A PLANE SURFACE

[76] Inventor: Carl Kramer, Am Chorusberg 8, D-5100 Aachen, Fed. Rep. of Germany

[21] Appl. No.: 823,434

[22] Filed: Jan. 28, 1986

[30] Foreign Application Priority Data

Jan. 30, 1985 [DE] Fed. Rep. of Germany ..... 3503089

[51] Int. Cl.[4] ..... F26B 9/06

[52] U.S. Cl. ..... 34/224; 34/231; 34/232; 266/251

[58] Field of Search ..... 34/24, 104, 222, 224, 34/229, 232, 231; 266/251, 252, 257

[56] References Cited

U.S. PATENT DOCUMENTS 3,849,906 11/1974 Hansen et al. ..... 34/229
3,887,135 6/1975 Tamai .
4,030,712 6/1977 Rogers ..... 266/252
4,155,701 5/1979 Primas .
4,261,517 4/1981 Hopkins et al. .

FOREIGN PATENT DOCUMENTS 2345734 3/1975 Fed. Rep. of Germany .
2454202 5/1976 Fed. Rep. of Germany .

*Primary Examiner*—Albert J. Makay
*Assistant Examiner*—David W. Westphal
*Attorney, Agent, or Firm*—Armstrong, Nikaido, Marmelstein & Kubovcik

[57] ABSTRACT

A device for the uniform application of gas on a plane surface comprises several slot-like openings which are at least approximately in one plane; the longitudinal axes of the nozzle openings are radially arranged, whereas the direction of the flow exiting from the slot-like openings is inclined towards the plane in which the openings are located. This allows an extremely uniform application so that the difference between the maximum and the minimum values of the heat-transfer coefficient is only very small.

9 Claims, 5 Drawing Sheets

DEVICE FOR THE UNIFORM APPLICATION OF GAS ON A PLANE SURFACE

BACKGROUND OF THE INVENTION

1. Field of the Invention

The present invention relates to a device for the uniform application of gas on a plane surface.

A particularly uniform application of gas on a surface is of great importance whenever heat is to be transferred to an article by means of this flowing gas, since only then a uniform heat transfer or possibly also material exchange between gas flow and surface is guaranteed, without any major differences in the local heat transfer coefficient leading to different temperatures and/or different heating of the article. This poses a great problem, for instance, in the warming of metal bobbins or spools. These are understood to be metal sheets, for instance, aluminum sheets wound to form a cylinder.

For the purpose of decreasing the annealing time one object is to increase as much as possible the heat transfer in a chamber furnace, as used for instance in the aluminum industry for the annealing of sheet bobbins or spools. If the blowing system used results in large local differences in the heat transfer, local warming may occur which causes discoloring of the metal sheets and moreover can impair the desired metallurgical properties of the sheets.

2. Description of the Prior Art

Conventional blowing systems which have a high heat transfer, have nozzles in the form of holes or slots which produce impact jets perpendicularly impinging on the front face of the metal bobbins or spools. If local overheating is determined, very often there is no choice but to reduce the overall volume flow and thus avoid the high local heat transfer coefficients.

SUMMARY OF THE INVENTION

Therefore, the invention has at its object to provide a device for the uniform application of gas on a plane surface of the given type, in which the above disadvantages no longer exist.

In particular, it is proposed to provide a device in which the differences between the maximum and minimum heat-transfer coefficients, that is possibly non-uniform application of the gas, are essentially smaller than in conventional blowing systems.

In accordance with the invention this object is solved in a device for the uniform application of gas on a plane surface comprising several slot-like openings which direct individual discrete gas jets onto the surface, in which the slot-like nozzle openings extend radially outwardly from an enclosed central portion; and the direction of the flow exiting through the slot-like nozzle openings is inclined with respect to the plane nozzle bottom in which the slot-like nozzle openings are accommodated.

Expedient forms embodiment are brought together in the subordinate claims.

The advantages achieved by the invention are especially due to the fact that in a simple embodiment still to be illustrated the ratio between the local maximum heat-transfer coefficient and the local minimum heat-transfer coefficient amounts to about 1.2, that is to say, the determinable difference between the two extreme values is very low. This has to be put into relation with a value of 1.9 for a blowing system using hole nozzles, and a value of about 1.7 for a blowing system using conventional slot nozzles which direct straight impact jets on the surface to be applied with gas.

This extremely uniform application means that on average a substantially higher volume flow can by directed onto the article to be heated than would be possible with other nozzle systems when maintaining the same maximum values for the local heat transfer. This results in a substantial reduction of the warming and cooling time as well as an increase of the ratio between the capacity flows of the gas flow serving the heat exchange and the mass of the article to be heated and cooled, respectively. This increase in the capacity flow ratio leads to lower temperature differences in the gas flow and thus reduces the risk of major temperature differences, for instance, by the formation of temperature streaks.

This new blowing system is especially suited for the application of a gas flow on the front faces of sheet bobbins or spools, the heat-transfer coefficient of which gas flow is more or less constant over the entire front face. Especially in the case of sheet bobbins or spools consisting of a metal, eg. aluminum, the warming takes place essentially through the front faces, since the heat conduction in radial direction equals only a fragment of the heat conduction in axial direction due to the isolating areas between the individual windings of the bobbin or spool.

BRIEF DESCRIPTION OF THE DRAWINGS

The invention is described in more detail hereinafter with the help of examples of embodiment with reference to the accompanying diagrammatic drawings. In these drawings

DESCRIPTION OF THE PREFERRED EMBODIMENTS

Figure 1:
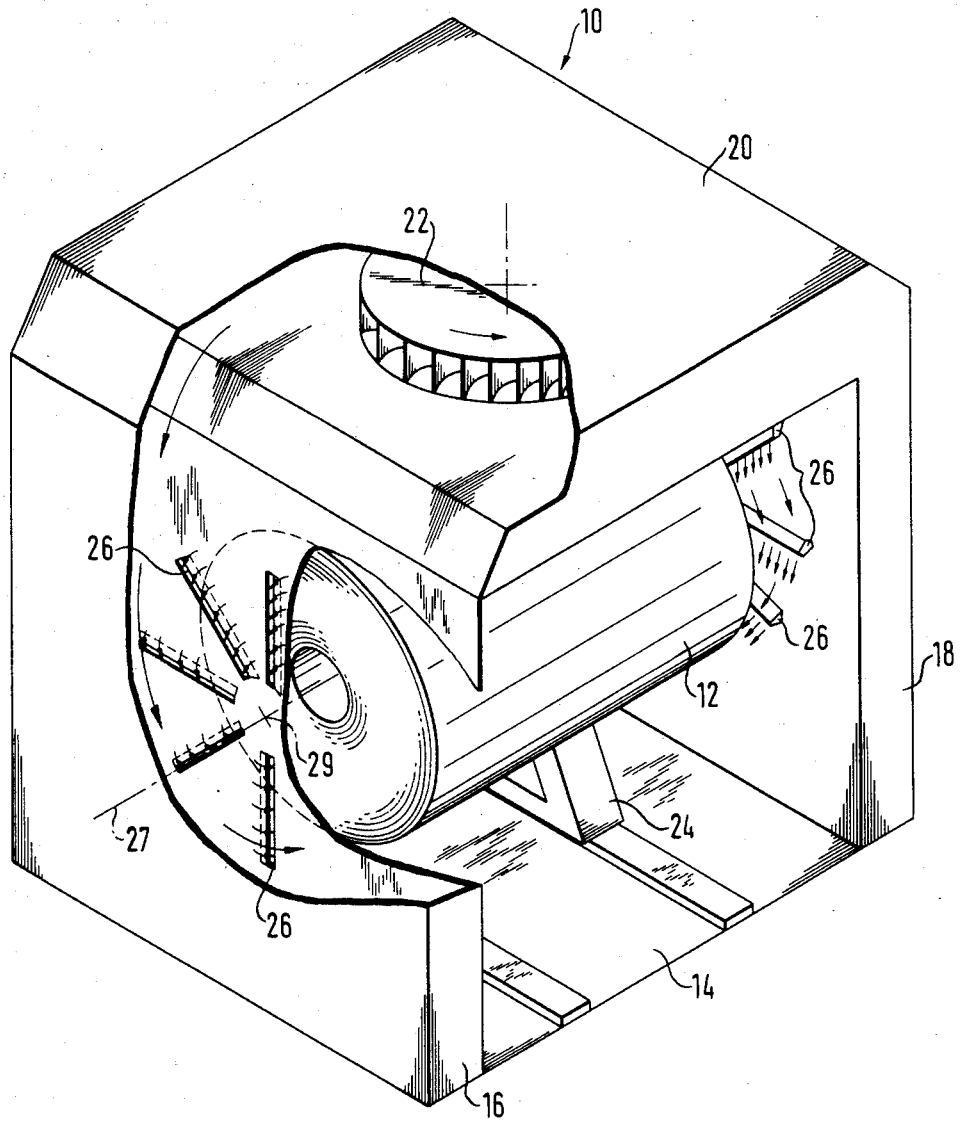
FIG. 1 shows a perspective, partially cut view of a device for the uniform application of gas on the two front faces of a sheet bobbin or spool.

The device for the uniform application on the two front faces of a metal sheet bobbin, in particular, of an aluminum-sheet bobbin 12, which device is generally given the reference numeral 10 and shown in FIG. 1, comprises an enclosed housing with a bottom 14, two hollow side walls 16, 18 designed as blowing chambers, and a cover 20 in which a radial fan 22, serving as a drive for the circulated gas flow, is integrated.

The sheet bobbin 12 is supported by rests 24 in such a way that its two front faces are facing the side walls 16 and 18.

The other two side walls not shown in FIG. 1 can be locked by doors and serve the charging of this "chamber furnace" 10.

Radially arranged slot nozzles 26 are integrated in the inner surfaces of the two side walls 16 and 18. The slot nozzles extend radially outwardly from a joint center 29. It is advantageous to arrange the sheet bobbin 12 such that its axis 27 extends as exactly as possible through these centers 29, that is concentric to the radial nozzle arrangement. The surface of the side walls 16, 18, which is covered by the slot nozzles 26, will be designated "nozzle bottom" below.

These slot nozzles 26 are located in a joint plane formed by the inner surface of the side walls 16, 18. Their nozzle openings too are at least approximately in one plane, the direction of the gas flow exiting from the nozzle openings being inclined towards the plane in which the nozzle openings are located.

Figure 5:
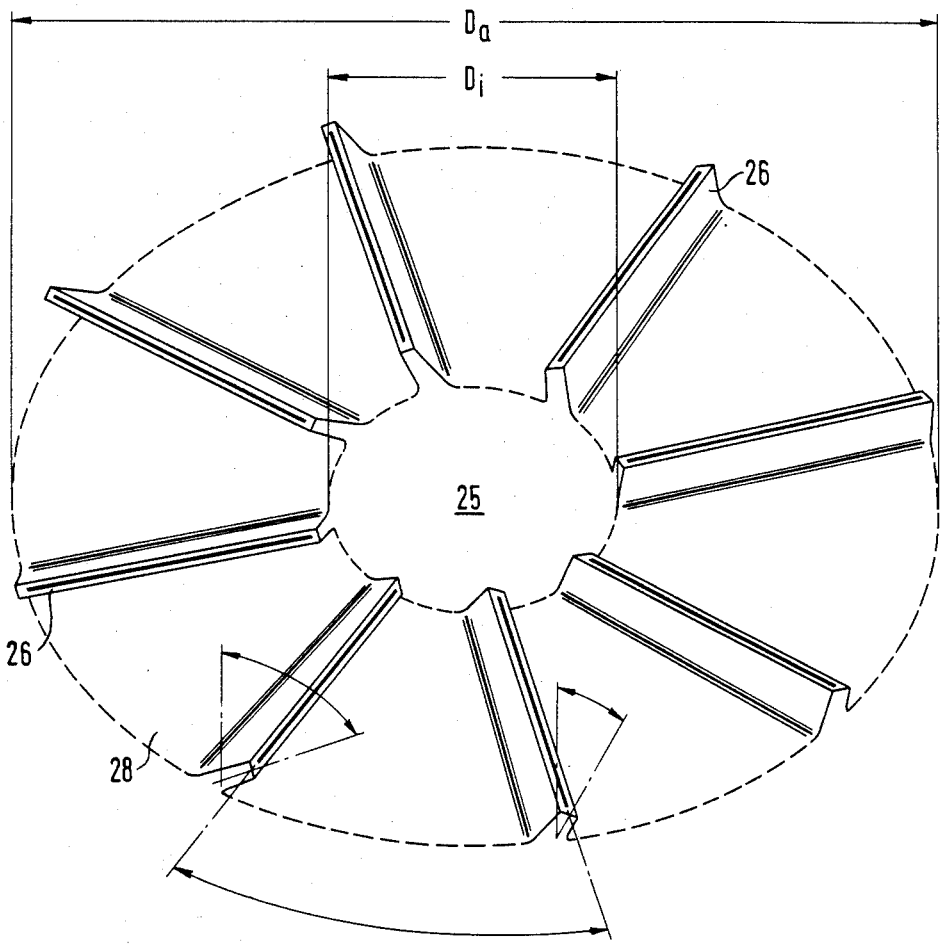
FIG. 5 shows a perspective view of the nozzle bottom with slot nozzles of different inclination.

FIG. 5 is a perspective view of the nozzle bottom indicated by reference numeral 28, from which the individual slot nozzles 26 project each with a different inclination, as can be seen from the angles shown.

In the middle of the nozzle bottom 28 there is a circular area having the diameter $D_i$, which is excluded, that is to say, no slot nozzles 26 are provided in this area 29. The slot nozzles 26 extend radially outwardly from the edge of the circular area 25 with the diameter $D_i$, in which connection both the angles between the individual slot nozzles 26 and the inclination of the slot nozzles with respect to the nozzle bottom 28 may be different.

The radial outer ends of the slot nozzles 26 are located in a circle having the diameter $D_a$.

Figure 6:
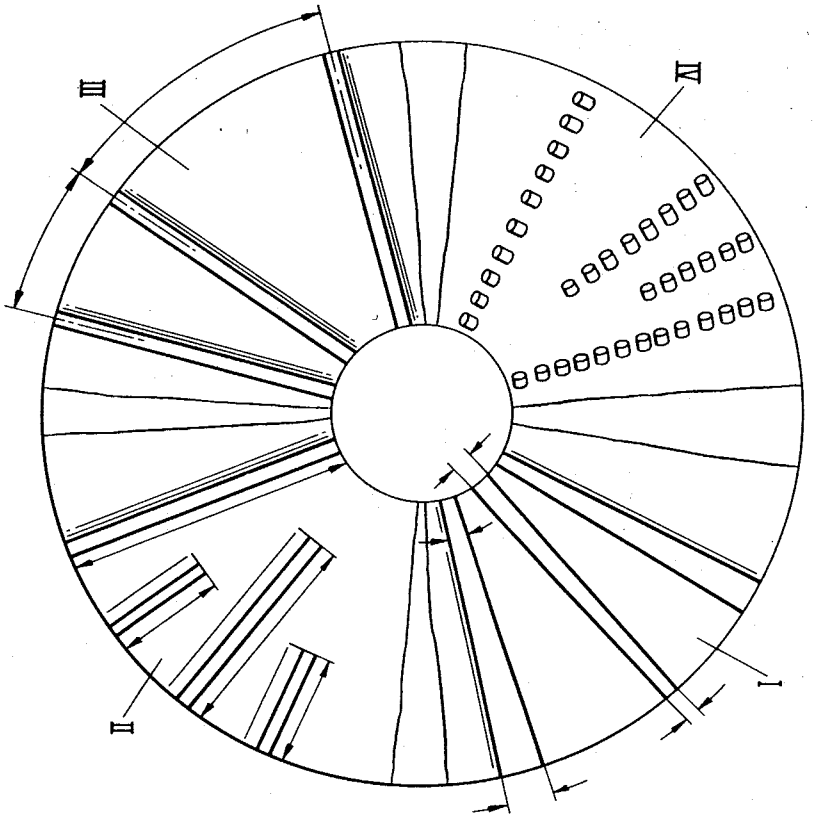
FIG. 6 shows a top view of the nozzle bottom with different embodiments of the slot nozzles.

FIG. 6 is a top view of different embodidments of the slot nozzles, that is in sector I slot-like openings of varying width in radial direction, in sector II slot nozzles of different extension in radial direction, in sector III slot nozzles with different angles between the individual jets and finally in sector IV an embodiment in which several radially extending rows of hole nozzles are used instead of the slot-like nozzle openings.

Figure 7:
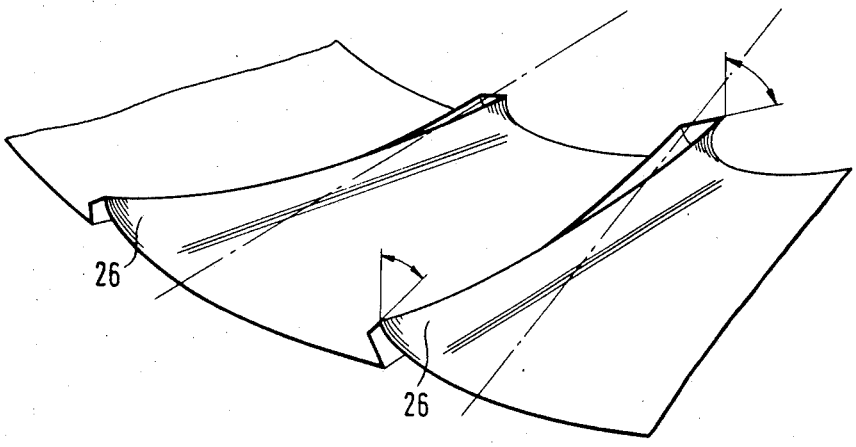
FIG. 7 shows a perspective, detailed view of two different embodiments of slot nozzles.

FIG. 7 is a detailed view of a modification in which the openings of the slot nozzles are "curved", i.e. the inclination of the slot nozzles 26 changes with the radius thus resulting in a curved slot axis.

Figure 8:
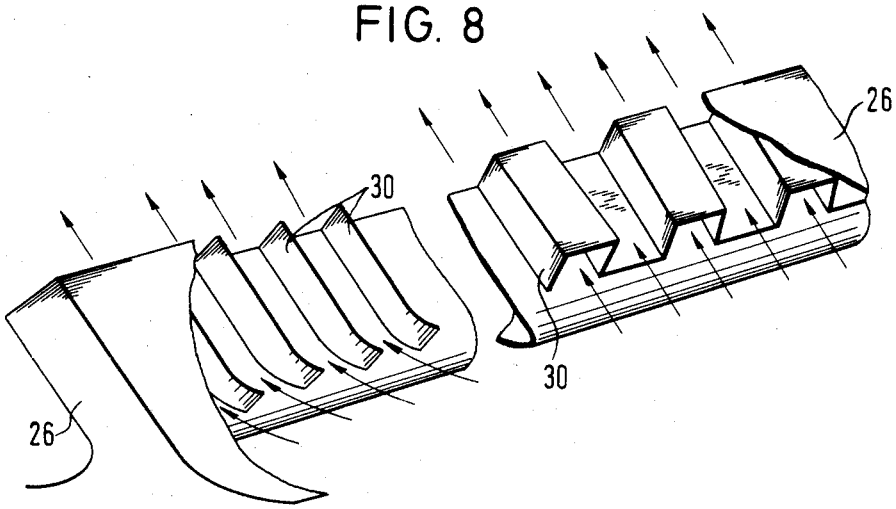
FIG. 8 shows detailed views of further embodiments of slot nozzles.

FIG. 8 shows two forms of embodiment in which flow-guide elements 30 are integrated in the slot-like nozzle openings, which in turn are adjusted to the inflow direction. These flow-guide elements 30 are either straight (right-hand variant) or, for instance, in a curved flow bent in corresponding direction (left-hand variant).

For example, in the embodiment shown in FIG. 5, the angle between the individual slot nozzles ranges between 26° and 45°.

Due to the inclination of the slot nozzles 26 towards the nozzle bottom 28 the slot jets exiting from the slot-like nozzle openings are likewise inclined towards the nozzle bottom 28.

The radial fan 22 rotating in the direction of the arrow generates an air flow which first of all flows outwardly and then is deflected downwardly into the hollow side walls 16, 18 in the direction of the arrows. Subsequently this gas flow exits from the hollow side walls 16, 18, i.e. from the slot nozzles 26, and it is applied to the front faces of the sheet bobbin 12. These front faces extend in parallel to the nozzle bottoms 28, that is to say, the slot nozzles 26 are inclined towards the front faces of the sheet bobbin 12.

The angle of inclination between the nozzle bottom 28 and the slot nozzles 26 is expediently selected in such a way that it corresponds to the sense of rotation of the vortex which results in conventional chamber furnace construction with the normal charging of the chambers in the side walls 16, 18 by means of the radial fan 22 built in the furnace cover 20. Due to adjusting the inclination to the direction of rotation of this vortex it is achieved that all slot nozzles 26 receive the gas flow from the same direction, which is advantageous with respect to a quantity distribution corresponding as exactly as possible to the cross-section of these slot nozzles 26.

Due to the inclination of the slot jets towards the front faces of the sheet bobbin 12 in the same direction a flow is caused on the blown front faces, which flow can be compared with that in a vortex.

The advantage obtained with the new embodiment as compared with conventional blowing devices is to be described below with reference to FIGS. 2 to 4.

Figure 2:
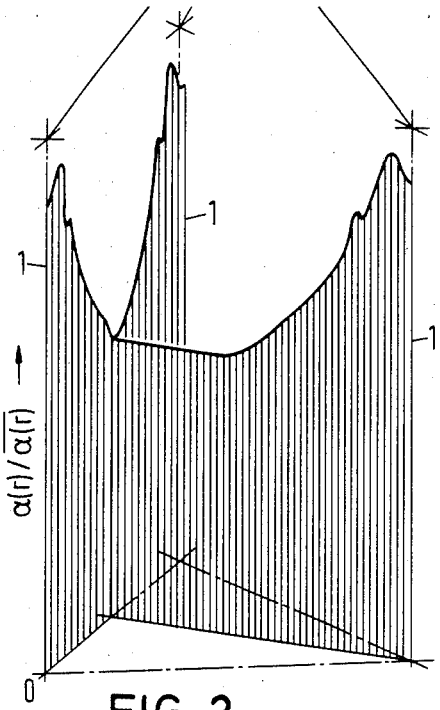
FIG. 2 shows a perspective view of the distribution of the local heat-transfer coefficient in a blowing system containing hole nozzles ($\alpha max/\alpha min = 1.9$)

FIG. 2 shows a perspective representation of the distribution of the local heat-transfer coefficients for a blowing system consisting of individual hole nozzles. Related to the axis of the nozzle jets (in FIG. 2 three nozzle jets are shown) a curve equalling a volcano crater in its cross-section results for the heat-transfer distribution. In the stagnation point a relative minimum is formed which is surrounded by a maximum value corresponding to the crater edge. The ratio between maximum and minimum heat-transfer coefficients is about 1.9.

Figure 3:
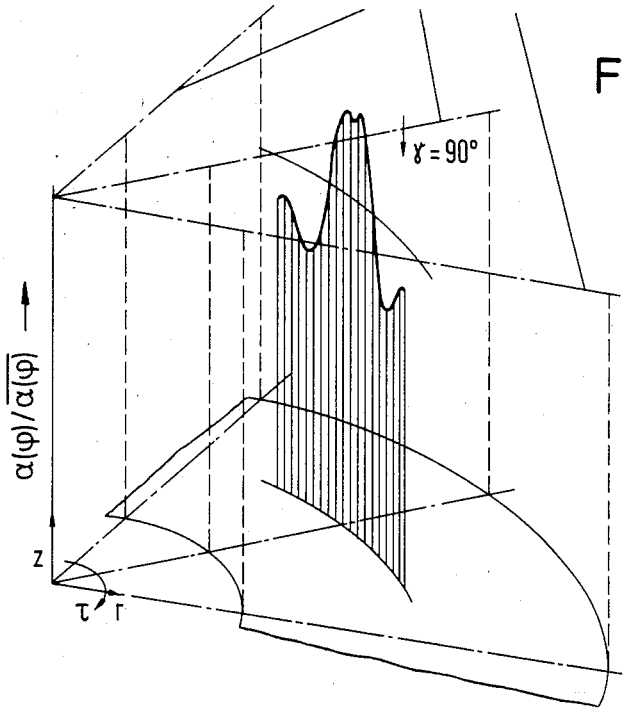
FIG. 3 shows a perspective view of the distribution of the local heat-transfer coefficient for a blowing system containing slot nozzles with perpendicularly impinging nozzle jets ($\alpha max/\alpha min = 1.7$)

FIG. 3 shows a corresponding, perspective representation of the distribution of the local heat-transfer coefficient for a slot nozzle system producing perpendicularly impinging nozzle jets. What results is a coarse similar to that in FIG. 2. Here, too, the distribution of the heat-transfer coefficient across the front face of a sheet bobbin applied with gas is not yet very uniform. The ratio between maximum and minimum heat-transfer coefficients is about 1.7.

Figure 4:
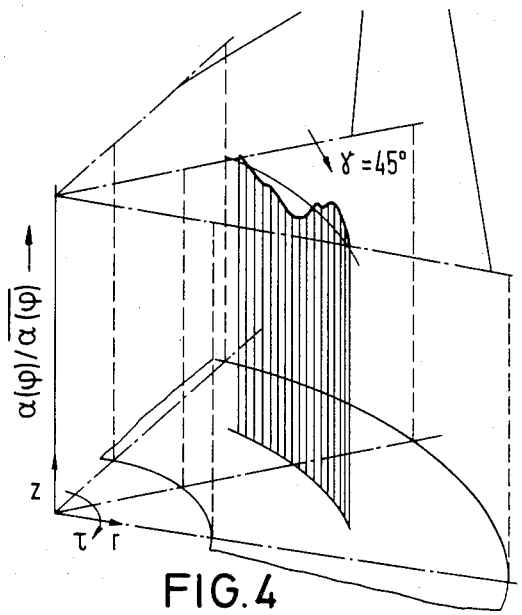
FIG. 4 shows a perspective view of the distribution of the local heat-transfer coefficient for a blowing system with inclined slot nozzles according to the invention ($\alpha max/\alpha min = 1.2$)

FIG. 4 finally is a perspective representation of the distribution of the local heat-transfer coefficient for a blowing system with inclined slot nozzles. The result is an extremely uniform heat-transfer coefficient, i.e. the ratio between the maximum value and minimum value is only 1.2.

If for instance a blowing with a maximum heat transfer of $170W(m^2K)$ is to be obtained, the maximum permissible average heat-transfer coefficient would be $110W/(m^2K)$ for the hole-nozzle system, $130W/(m^2K)$ for the slot-nozzle system with perpendicularly impinging nozzle jets and $160W/(m^2K)$ for the new blowing system with the inclined slot nozzles.

I claim:

1. A device for the uniform application of gas on a plane surface comprising:

a planar stationary nozzle bottom; and a plurality of slit-shaped nozzle openings provided in said planar nozzle bottom said slit-shaped nozzle openings extending radially outward in a beam-like array from a closed central portion of said planar nozzle bottom, said slit-shaped nozzle openings directing individual, discrete gas slot jets onto said plane surface, all said gas slot jets, exiting all said slit-shaped nozzle openings, being inclined in the same direction with respect to a sense of rotation around a center point of the beam-like array.

2. Device according to claim 1, in which the slit-shaped nozzle openings have different cross-sectional widths in the radial direction.

3. Device according to claim 1, in which the cross-section of the slit-shaped nozzle openings increase outwardly in a radially linear manner from a central portion.

4. Device according to claim 1, in which the inclination of the flow exiting from the slit-shaped nozzle openings changes in the radial direction along the nozzle openings.

5. Device according to claim 1, in which the slit-shaped nozzle openings are of different lengths in the radial direction.

6. Device according to claim 1, in which the angles between the radially arranged longitudinal axes of the nozzle-exit cross-sections are different.

7. Device according to claim 1, in which the slit-shaped nozzle openings are constructively formed by rows of perforations.

8. Device according to claim 1, in which flow-guide elements are provided in or upstream of the slit-shaped nozzle openings.

9. A device for the uniform application of gas on a plane surface comprising;

an enclosed housing having:

a bottom, four walls, two of said walls being hollow side walls for use as blowing chambers, and a cover having a radial fan disposed therein, said radial fan deflecting said gas downwardly through said hollow walls, said hollow walls each having, on an inner surface, a center portion and a plurality of slit-shaped nozzle openings, said slit-shaped nozzle openings extending radially outward in a beamlike array from said center portion, said slit-shaped nozzle openings directing individual, discrete gas slot jets onto said plane surface, all said gas slot jets, exiting all said slitshaped nozzle openings, being inclined in the same direction with respect to a sense of rotation of a center point of the beam-like array.

* * * * *